US011239598B2

(12) United States Patent
Kimura et al.

(10) Patent No.: US 11,239,598 B2
(45) Date of Patent: Feb. 1, 2022

(54) CONNECTOR HOUSING HAVING A LATCH ARM WITH A LOWER RIGIDITY

(71) Applicant: Tyco Electronics Japan G.K., Kawasaki (JP)

(72) Inventors: Takeshi Kimura, Kawasaki (JP); Yukinori Sugita, Kawasaki (JP); Daigoro Fujii, Kawasaki (JP)

(73) Assignee: Tyco Electronics Japan G.K., Kawasaki (JP)

( * ) Notice: Subject to any disclaimer, the term of this patent is extended or adjusted under 35 U.S.C. 154(b) by 0 days.

(21) Appl. No.: 16/863,388

(22) Filed: Apr. 30, 2020

(65) Prior Publication Data

US 2020/0366024 A1 Nov. 19, 2020

(30) Foreign Application Priority Data

Apr. 30, 2019 (JP) ..... JP2019-087049

(51) Int. Cl.

| | |
|---|---|
| ***H01R 13/50*** | (2006.01) |
| ***H01R 43/18*** | (2006.01) |
| ***H01R 13/422*** | (2006.01) |
| ***H01R 13/627*** | (2006.01) |

(52) U.S. Cl.

CPC ..... *H01R 13/50* (2013.01); *H01R 13/4223* (2013.01); *H01R 13/6272* (2013.01); *H01R 43/18* (2013.01)

(58) Field of Classification Search

CPC ..... H01R 13/50; H01R 13/4223; H01R 13/6272; H01R 13/502; H01R 13/5025; H01R 13/501; H01R 43/18

USPC ..... 439/350, 352, 353, 354

See application file for complete search history.

(56) References Cited

U.S. PATENT DOCUMENTS

| | | | | |
|---|---|---|---|---|
| 4,623,210 | A * | 11/1986 | Tsukakoshi | H01R 13/6272 439/358 |
| 4,984,998 | A * | 1/1991 | Duncan | H01R 13/627 439/352 |
| 5,470,258 | A * | 11/1995 | Suzuki | H01R 13/4223 439/595 |
| 5,554,044 | A * | 9/1996 | Nishide | H01R 13/6272 439/352 |
| 6,261,115 | B1 * | 7/2001 | Pederson | H01R 13/6272 439/352 |

(Continued)

FOREIGN PATENT DOCUMENTS

| | | |
|---|---|---|
| JP | 6223911 A | 8/1994 |
| JP | 9-248577 A | 9/1997 |

(Continued)

*Primary Examiner* — Marcus E Harcum
(74) *Attorney, Agent, or Firm* — Barley Snyder

(57) ABSTRACT

A connector housing includes a housing main body formed from a first material and a latch arm formed from a second material having a lower rigidity than the first material. The latch arm extends in a cantilever form, forms a boundary portion at a connection between the latch arm and the housing main body, and is configured to elastically deform in relation to the housing main body to latch a latched member. A transition region having a continuously variable mixing ratio between the first material and the second material is present within an expanded boundary region including the boundary portion and expanding into the housing main body and into the latch arm.

12 Claims, 3 Drawing Sheets

(56) References Cited

U.S. PATENT DOCUMENTS 6,290,539 B1 * 9/2001 Wilber ..... H01R 13/4223 439/595
6,422,759 B1 * 7/2002 Kevern ..... G02B 6/3825 385/58
6,431,887 B1 * 8/2002 Yeomans ..... H01R 13/6583 439/108
7,004,791 B2 * 2/2006 Mumper ..... H01R 43/18 439/595
7,572,148 B1 * 8/2009 Pepe ..... H01R 13/514 439/607.05
7,651,361 B2 * 1/2010 Henry ..... H01R 13/6335 439/352
7,682,180 B2 * 3/2010 Brown ..... H01R 13/4223 439/352
7,955,142 B1 * 6/2011 Shuey ..... H01R 13/436 439/752
9,140,859 B2 * 9/2015 Anderson ..... G02B 6/3893
2005/0106918 A1 * 5/2005 Colantuono ..... H01R 24/64 439/290
2006/0178029 A1 * 8/2006 Fabian ..... H01R 13/642 439/284
2006/0246771 A1 * 11/2006 Pepe ..... H01R 13/6683 439/498
2007/0020986 A1 * 1/2007 Fry, Jr. ..... H01R 13/6272 439/357
2007/0059973 A1 * 3/2007 Fabian ..... H01R 13/112 439/475
2007/0093120 A1 * 4/2007 Hardy ..... H01R 13/508 439/468
2008/0139034 A1 * 6/2008 Dieterle ..... H01R 13/6272 439/352
2009/0247011 A1 * 10/2009 Myer ..... H01R 13/4365 439/595
2011/0111617 A1 * 5/2011 Handshaw ..... H01R 13/5845 439/352
2011/0237111 A1 * 9/2011 Liu ..... H01R 13/6272 439/354
2013/0260590 A1 * 10/2013 Hitchcock ..... H01R 13/6397 439/312
2013/0323949 A1 * 12/2013 De Dios Martin ..... H01R 13/6335 439/160
2014/0106597 A1 * 4/2014 Gimbel ..... H01R 13/62 439/345
2016/0118741 A1 * 4/2016 Schmidt ..... H01R 13/6272 439/131
2017/0373435 A1 * 12/2017 Denz ..... H01R 13/6272
2018/0323544 A1 * 11/2018 Wu ..... H01R 24/62
2019/0097354 A1 * 3/2019 Zheng ..... H01R 13/6272
2019/0326706 A1 * 10/2019 Penn ..... H01R 24/40
2020/0136307 A1 * 4/2020 Tanaka ..... H01R 13/6272

FOREIGN PATENT DOCUMENTS

JP 2001-115037 A 4/2001
JP 2017-177738 A 10/2017

* cited by examiner

CONNECTOR HOUSING HAVING A LATCH ARM WITH A LOWER RIGIDITY

CROSS-REFERENCE TO RELATED APPLICATION

This application claims the benefit of the filing date under 35 U.S.C. § 119(a)-(d) of Japanese Patent Application No. 2019-087049, filed on Apr. 30, 2019.

FIELD OF THE INVENTION

The present invention relates to a connector housing and, more particularly, to a connector housing having a latch arm.

BACKGROUND

Conventionally, a connector housing is provided with a latch arm for catching a latched member of, for example, a mating housing or the like, to retain the latched member. Such a connector housing is, for example, disclosed in JPH04-137474A. The latch arm extends like a cantilever from a housing main body and has a structure at an intermediate portion of the cantilever for locking onto the latched member.

The housing main body is required to have high rigidity so as not to deform easily. On the other hand, the latch arm is required to deform elastically temporarily so as to catch the latched member of, for example, a mating housing. If this latch arm is formed from the same material as the housing main body, an operating force for the latch arm becomes too large.

JPH02-186569A discloses a connector housing having a housing main body made of a hard material and a hinge made of a soft material different from the hard material, by a multi-material injection molding technique. To form the housing main body and the latch arm from different materials suitable for the housing main body and the latch arm, respectively, it is possible to apply the multi-material injection molding technique disclosed in JPH02-186569A to a lock arm. However, multi-material injection molding is costly because a molding process is performed twice. Also, multi-material injection molding is likely to cause separation of the housing main body and the lock arm at their juncture, which can result in a lack of reliability.

JP2017-177738A discloses a molding device in which different resin materials are injected from a plurality of gates (inlets) of a mold. JP2017-177738A, however, does not disclose a connector housing.

SUMMARY

A connector housing includes a housing main body formed from a first material and a latch arm formed from a second material having a lower rigidity than the first material. The latch arm extends in a cantilever form, forms a boundary portion at a connection between the latch arm and the housing main body, and is configured to elastically deform in relation to the housing main body to latch a latched member. A transition region having a continuously variable mixing ratio between the first material and the second material is present within an expanded boundary region including the boundary portion and expanding into the housing main body and into the latch arm.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
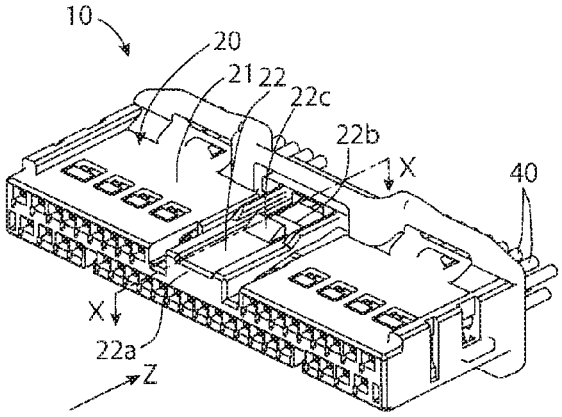
FIG. 1 is a perspective view of a connector.

Exemplary embodiments of the present disclosure will be described hereinafter in detail with reference to the attached drawings, wherein like reference numerals refer to like elements. The present disclosure may, however, be embodied in many different forms and should not be construed as being limited to the embodiments set forth herein; rather, these embodiments are provided so that the present disclosure will convey the concept of the disclosure to those skilled in the art. Furthermore, several aspects of the embodiments may form—individually or in different combinations—solutions according to the present invention. The following described embodiments thus can be considered either alone or in an arbitrary combination thereof.

Figure 2:
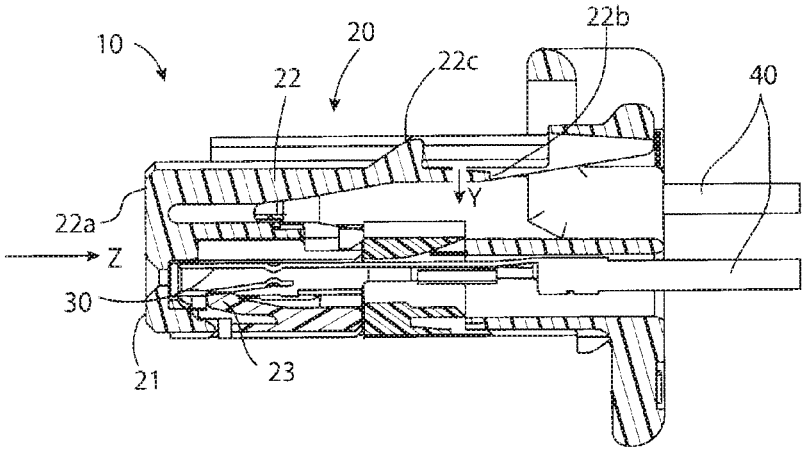
FIG. 2 is a sectional side view of the connector taken along arrows X-X of FIG. 1.

A connector 10 according to an embodiment, as shown in FIGS. 1 and 2, comprises a connector housing 20 and a contact 30 inserted in the connector housing 20. A cable 40 is connected to the contact 30, and the cable 40 extends to an outside of the connector housing 20. It should be noted that only a portion of the cable 40 that is in the vicinity of the connector housing 20 is shown in FIGS. 1 and 2.

The connector housing 20, as shown in FIGS. 1 and 2, has a housing main body 21 and a latch arm 22. The connector housing 20 is one example of a connector housing of the present disclosure. The latch arm 22 has a front end 22*a* connecting with the housing main body 21 and extends rearward like a cantilever, using the front end 22*a* as a fixed end. The latch arm 22 has a latch protrusion 22*c* in between the front end 22*a* that is the fixed end, and a rear end 22*b* that is a free end.

A mating connector is mated with the connector 10 in a direction of an arrow Z in FIGS. 1 and 2. In the course of mating, the latch protrusion 22*c* is pressed by a housing of the mating connector. Thereupon, this latch arm 22 elastically deforms in a direction of an arrow Y shown in FIG. 2. Then, once the connectors are in a completely-mated state, the latch protrusion 22*c* is released from depression by the mating connector and returns to its original form. Thereby, the mating connector is put into a locked state so as not to be easily released from the connector 10.

A material whose rigidity has been increased by mixing a resin material with glass is used for the housing main body 21. A material that is the same resin material as the housing main body 21 but not mixed with glass is used for the latch arm 22. In another embodiment, a material mixed with glass in a mixing ratio lower than a mixing ratio for the housing main body 21 may also be used for the latch arm 22 in order to adjust rigidity. By mixing glass, the rigidity becomes higher as the mixing ratio increases, and the material becomes more suitable for elastic deformation as the mixing ratio decreases. The housing main body 21 therefore has the required rigidity while the latch arm 22 is suitable for elastic deformation.

A material mixed with a pigment of a color may be used for the latch arm 22 to distinguish it at a glance from the housing main body 21, which is not mixed with the pigment in an embodiment. It should be noted that, instead of mixing the latch arm 22 with the pigment, the material of the housing main body 21 may instead be mixed with the pigment.

Figure 3:
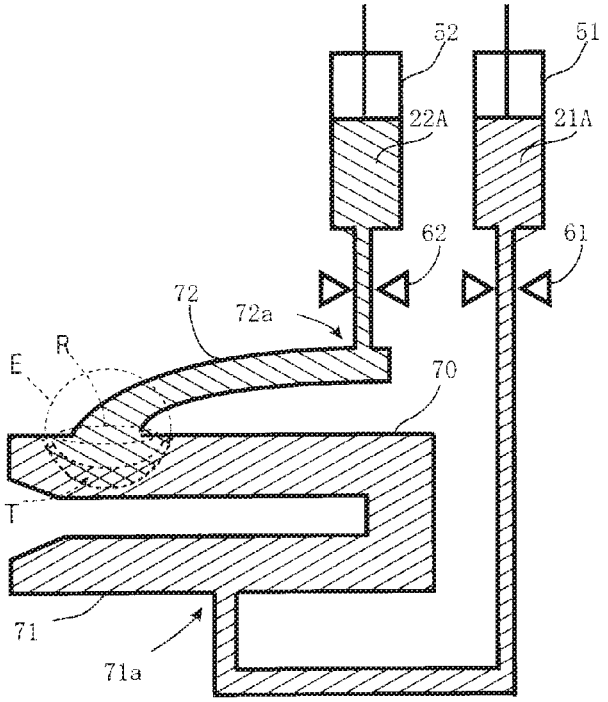
FIG. 3 is a schematic view of a cavity of a mold for manufacturing a connector housing of the connector.

FIG. 3 is a schematic view showing an outline of a manufacturing process of the connector housing 20.

A cavity 70 of a mold for manufacturing the connector housing 20 is shown in FIG. 3. The cavity 70 has a housing main body portion 71 for molding the housing main body 21, and a latch arm portion 72 for molding the latch arm 22. The mold has inlets 71*a*, 72*a* that connect with each of the housing main body portion 71 and the latch arm portion 72, respectively, for injecting the materials into the mold.

As shown in FIG. 3, the mold has a pair of cylinders 51, 52. A first cylinder 51 connects with a first inlet 71*a*. A first material 21A for the housing main body 21 is accumulated in the first cylinder 51. A second cylinder 52 connects with a second inlet 72*a*. A second material 22A for the latch arm 22 is accumulated in the second cylinder 52.

In an embodiment, timings of opening a pair of valves 61, 62 shown in FIG. 3 are adjusted to inject the materials 21A, 22B into the cavity 70 of the mold. Thereupon, the first material 21A for the housing main body 21 is injected into the housing main body portion 71 of the cavity 70, and the second material 22A for the latch arm 22 is injected into the latch arm portion 72 of the cavity 70. Thereupon, a transition region T is formed, in which the two kinds of materials 21A, 22A before hardening are mixed together. This transition region T is a region having a higher ratio of the first material 21A constituting the housing main body 21 as it approaches the housing main body portion 71, and having a higher ratio of the second material 22A constituting the latch arm 22 as it approaches the latch arm portion 72. The transition region T has a continuously variable mix ratio between the first material 21A and the second material 22A.

The transition region T, as shown in FIG. 3, does not necessarily coincide with the boundary portion R between the housing main body 21 and the latch arm 22. That is, the transition region T is only required to be present within an expanded boundary region E that includes the boundary portion R and expands into the housing main body 21 and into the latch arm 22. In the embodiment shown in FIG. 3, the transition region T is formed in a region recessed into the housing main body 21.

In this manner, the connector housing 20 having the housing main body 21 formed from the first material 21A having high rigidity, and the latch arm 22 formed from the second material 22A suitable for elastic deformation, is completed. Moreover, the connector housing 20, unlike a connector housing formed by multi-material injection molding, has the transition region T in which the material is integrated and continuously variable. As a result, an accident where the latch arm 22 is separated from the housing main body 21 may be prevented with high reliability. The connector housing 20 is accordingly highly reliable.

The housing main body 21 and the latch arm 22, as described above, may have different colors from each other. This makes it possible to easily confirm that the materials are mixed well in the transition region T.

It should be noted that, here, using a material whose rigidity has been adjusted by mixing or not mixing glass, or by mixing different ratios of glass, has been described by way of example. However, this is an example, and different mixing substances may be mixed in. In another embodiment, the resin materials themselves may be different resin materials from each other.

Also, here, the latch arm 22 that latches a housing of a mating connector has been described. However, the latch arm 22 referred to in the present disclosure is not limited to a latch arm that latches a housing of a mating connector. For example, the latch arm 22 referred to in the present disclosure may be a latch arm that catches the contact 30 inserted into the connector housing 20 to retain the contact 30, such as a contact lance 23 shown in FIG. 2.

What is claimed is:

1. A connector housing, comprising:

a housing main body formed from a first material; and a latch arm formed from a second material having a lower rigidity than the first material, the latch arm extending in a cantilever form, forming a boundary portion at a connection between the latch arm and the housing main body, and being configured to elastically deform in relation to the housing main body to latch a latched member, a transition region having a continuously variable mixing ratio between the first material and the second material is present within an expanded boundary region including the boundary portion and expanding into the housing main body and into the latch arm.

2. The connector housing of claim 1, wherein the first material is a material blended with glass.

3. The connector housing of claim 2, wherein the second material is a material not blended with glass.

4. The connector housing of claim 2, wherein the second material is a material having a lower glass blending ratio than the first material.

5. The connector housing of claim 1, wherein the latch arm is a latch arm for latching a mating housing mated with the connector housing.

6. The connector housing of claim 1, wherein the latch arm is a contact lance catching a contact inserted into the connector housing.

7. The connector housing of claim 1, wherein the first material and the second material are different in color from each other.

8. The connector housing of claim 7, wherein the first material is mixed with a pigment of a color and the second material is not mixed with the pigment.

9. The connector housing of claim 7, wherein the second material is mixed with a pigment of a color and the first material is not mixed with the pigment.

10. The connector housing of claim 1, wherein the latch arm has a front end connected with the housing main body and a rear end that is a free end.

11. The connector housing of claim 10, wherein the latch arm has a latch protrusion between the front end and the free end.

12. The connector housing of claim 1, wherein the housing main body and the latch arm are integrally formed.

* * * * *